US005515748A

United States Patent [19]

Yagi

[11] Patent Number: 5,515,748

[45] Date of Patent: May 14, 1996

[54] ENGINE CONTROL DEVICE AND ACTUATOR FOR THE SAME

[75] Inventor: Mikiya Yagi, Hyogo, Japan

[73] Assignee: Nippon Cable System Inc., Hyogo, Japan

[21] Appl. No.: 247,981

[22] Filed: May 23, 1994

[30] Foreign Application Priority Data

May 21, 1993 [JP] Japan ..... 5-142750

[51] Int. Cl.[6] ..... G05G 11/00

[52] U.S. Cl. ..... 74/625; 74/490.11; 74/500.5; 74/501.6; 192/69.62; 192/69.7

[58] Field of Search ..... 74/490.11, 500.5, 74/501.6, 625; 192/67 P, 83, 69.62, 69.7

[56] References Cited

U.S. PATENT DOCUMENTS

| | | | |
|---|---|---|---|
| 1,858,624 | 5/1932 | Hess et al. | 74/625 |
| 3,515,250 | 6/1970 | Cantalupo | 74/625 X |
| 4,136,577 | 1/1979 | Borgersen | 192/67 P X |
| 4,257,192 | 3/1981 | Bartholomew | 74/625 X |
| 4,285,496 | 8/1981 | Coles | 74/625 X |
| 4,643,148 | 2/1987 | Jedrziewski | 74/625 X |
| 4,854,188 | 8/1989 | Griffiths | 74/625 |

FOREIGN PATENT DOCUMENTS

| | | |
|---|---|---|
| 3-220093 | 9/1991 | Japan . |
| 3-249339 | 11/1991 | Japan . |
| 3-253494 | 11/1991 | Japan . |

*Primary Examiner*—Allan D. Herrmann
*Attorney, Agent, or Firm*—Lowe, Price, LeBlanc & Becker

[57] ABSTRACT

An engine control device for a boat, ordinary operated with power-assisting actuator, and manually operated through control cable at emergency state. The actuator has a rotary shaft supported by a casing, a slide gear mounted on the rotary shaft in axially slidable and non-rotatable, an output lever fixed on the rotary shaft, a manual input lever co-axially rotatable with the shaft. The slide gear has peripheral teeth for meshing with reduction gear and an engaging portion capable of engaging with the manual input lever.

10 Claims, 9 Drawing Sheets

ENGINE CONTROL DEVICE AND ACTUATOR FOR THE SAME

BACKGROUND OF THE INVENTION

The present invention relates to an engine control device for remote-controlling an engine of a boat, an industrial vehicle or the like. In this specification, the word "engine" has broad concept and includes also peripheral devices of engine, such as clutch.

There has been hitherto known an engine control device using a push-pull control cable. In such device, a remote control terminal or control box is operatively connected to an object engine through a push-pull control cable. Then operator's operation of a lever in the control box is transmitted to the engine side so as to control a governor in diesel engine or to change a forward/stop/reverse mode of clutch through the push-pull cable.

However, when the push-pull cable becomes long in arrangement length, control accuracy becomes low since frictional resistance and backlash become large. Further, manual operation becomes laborious due to large operational force.

Recently, several types of electric power-assisted engine control device are proposed, for example, in Japanese patent publications, Tokkai Hei3-249339, Tokkai Hei3-220093, Tokkai Hei3-253494. In those devices, a powered actuator is provided near an engine an output member of the actuator is connected with an input member of the engine through a short push-pull cable, and the device is constructed so that electric control signal is transmitted from the control box to the electric motor of the actuator. Among those publications, Tokkai Hei 3-220093 discloses an actuator which has an emergency lever capable of manually operating the push-pull cable. In the device, at a state of emergency, such as trouble of battery or power supply, the motor is disconnected and the device is enabled to be manually operated.

Further, the publication Tokkai Hei 3-253494 discloses a device which has not only a powered control system for remotely controlling a motor in the actuator, but also a manual remote control system for controlling the actuator by means of a push-pull cable, and further has a means for changing the systems by operating a solenoid actuator or the like. Further, the publication discloses a system changing mechanism in which an output of motor is transmitted to an inner cable of the push-pull cable for engine control and an output member for the manual operation is connected to a lever supporting an end of a conduit of the push-pull cable. The publication also discloses a device in which transmitting routes are changed by changing pivotal fulcrums of an output lever.

The device of Tokkai Hei3-220093 is inconvenience since operator should manually operate the actuator near the engine at the state of emergency. Further, the size of actuator is large since the device includes a rack and pinion mechanism.

On the other hand, though the device of Tokkai Hei3-253494 has an advantage that operator can manually operate at operator's seat in cabin, the changing mechanism is very complicated in structure, and the size is large. Further, in the device, input from electrically power-assisted operation route and input from manual operation route are composed by the changing mechanism so that the component is outputted, and the operation routes are mutually changed by blocking one route and operating another route. Therefore, when the device stops on the way of operation, the device must be changed from power mode to manual mode and be operated from such situation that is deviated from the normal operation area. Further, the operation to return the device into powered mode from manual mode is very complicated, since the device must be returned to a neutral position at once, the manual lever must be locked, and the like.

One of objects of the present invention is to provide an engine control device which can be remotely controlled from a skipper's seat in cabin, which is simple in construction, which can be easily changed in operation mode from powered mode to manual mode, and which can be operated in normal operation area after the change of mode.

Another object of the present invention is to provide an actuator suitable for the above engine control device.

Further another object of the present invention is to provide an engine control device which is easy in return operation from manual mode to power mode, and which can utilize a position detector for feedback control not only in power mode but also in manual mode.

SUMMARY OF THE INVENTION

According to the present invention, there is provided an engine control device comprising a signal generating unit to be operated by an operator for generating engine control signal, a controller for receiving the engine control signal and for outputting motor control signal in accordance with the engine control signal, an actuator having an electric motor which rotates in accordance with the motor control signal and a cable driving part for driving an engine control cable, a manual remote control unit, and a manual control cable operated by the manual remote control unit. The cable driving part of the actuator has a power input member rotated by the motor, a manual input member rotated through the manual control cable; an output member connected with the engine control cable; an intermediate member for selectively connecting one of the input members to the output member and, at the same time, disconnecting another input members from the output member; and a means for operating the intermediate member.

Further, in another aspect of the present invention, there is provided an actuator for an engine control device comprising a pinion driven by an electric motor; an output member for operating an engine control cable; a manual input member which is driven through a manual control cable; a rotary shaft rotatably supported in a casing and fixedly carrying the output member; a slide gear carried on the rotary shaft so as to be axially slidable and torque-transmittable; said slide gear having teeth which mesh with the pinion at a first axial position and an having engaging portion with engages which the manual input member at a second axial position; and a means for selectively sifting the slide gear to the first position or the second position.

In the above mentioned engine control device, at ordinary powered mode, the intermediate connecting member is jointed to the output member with making the manual input member free. At this power mode, motor torque controlled by signal from the signal generating unit is transmitted to the power input member, the intermediate member and the output member. Then the output member drives a governor or clutch of engine.

At emergency state such as trouble of electric source, the intermediate member is jointed to the manual input member with making the power input member free. At this manual mode, the part to be controlled of the engine can be manually controlled by operating a manual remocon box, through the manual control cable, the manual input member, the intermediate member, the output member and the engine control cable.

In the above mentioned actuator, in ordinary state, the slide gear is shifted to the first axial position. At this power mode, the pinion is driven by the motor, and the pinion rotates the slide gear, since the slide gear meshes with the pinion. The rotary shaft therefore rotates, and the output member also rotates. Then, the engine part can be controlled through engine control cable.

In emergency state, the slide gear is rotated until the angular position of the output member becomes to accord to the manual input member, and the slide gear is sifted to the second axial position. Then, the slide gear is disconnected from motor side to be free, and the engaging part engages to the manual input member. At this manual mode, the manual input member is rotated by means of manual remocon unit through manual control cable. Since the operation is transmitted to the output member through the slide gear, the engine can be controlled through the engine control cable.

In an embodiment of the actuator having a neutral position of the slide gear, the slide gear can be easily rotated to accord the position to the manual input member after the slide gear is shifted on the neutral position. Then, the slide gear is further shifted to the second position in order to engage the slide gear with the manual input member. Therefore, the device can be easily changed from power mode to manual mode.

In another embodiment of actuator having a detector to detect angular position of the rotary shaft, accuracy feedback control can be obtained not only in power mode but also in manual mode, since the detector detects the angle of rotary shaft which always corresponds to the control state of the engine. Such obtained feedback signal is used for controlling motor at power mode, and also can be used for indicate the engine control state, for example, at the manual mode.

In another embodiment of the actuator, when the slide gear is engaged with manual input member, at the same time the slide gear combines the manual input member to the output member like one body. Therefore, backrash is small during the manual mode, and operation feeling is good.

In another embodiment of actuator, since the slide gear, the rotary shaft and the shifting means such as knob are compactly combined, the device is thin in axial direction of rotary shaft.

Hereinafter, some embodiments of the engine control device and actuator of the present invention are explained with reference to the following drawings.

DETAILED DESCRIPTION OF THE PRESENT INVENTION

Figure 2:
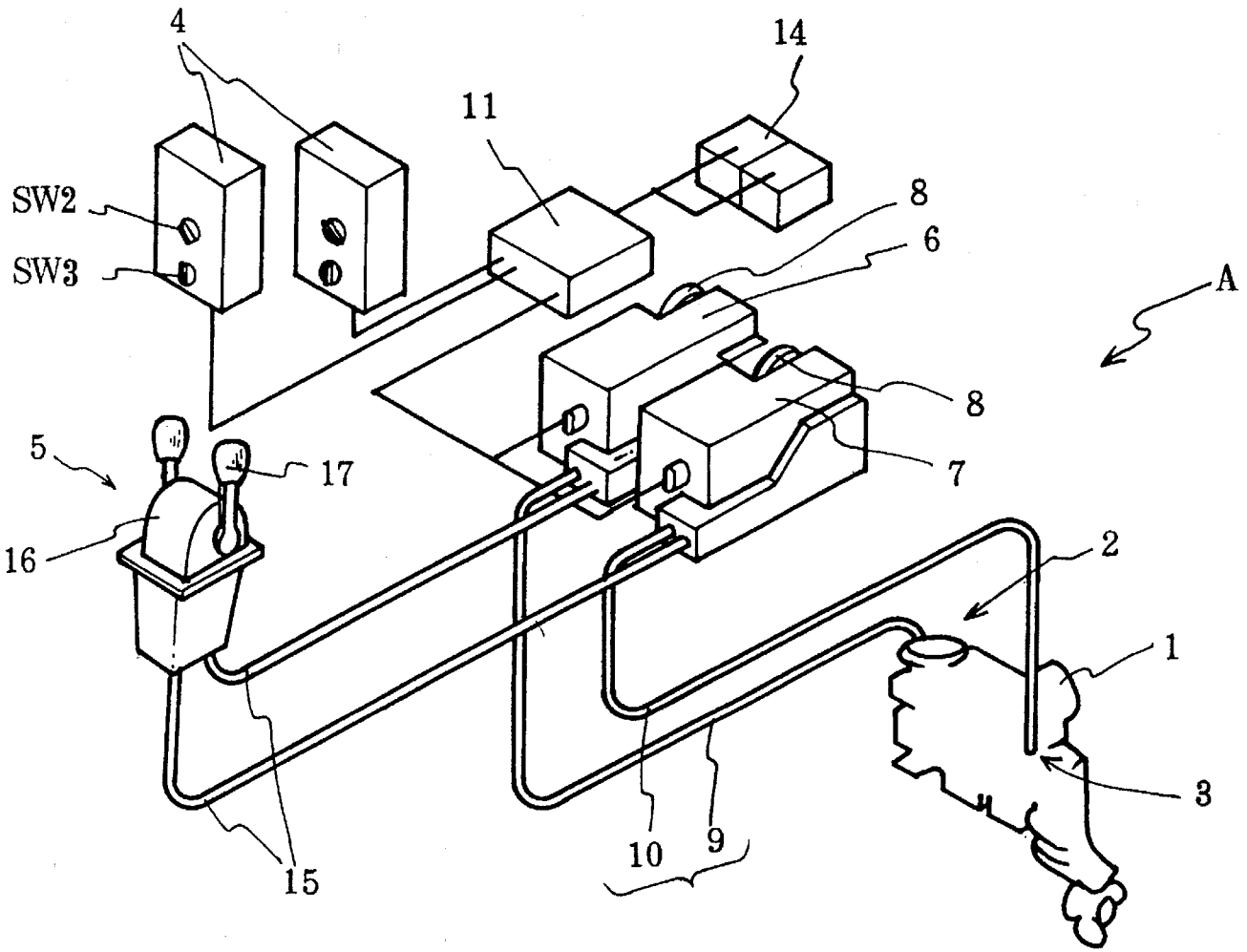
FIG. 2 is a schematic perspective view showing an embodiment of an engine control device of the present invention.
Figure 3:
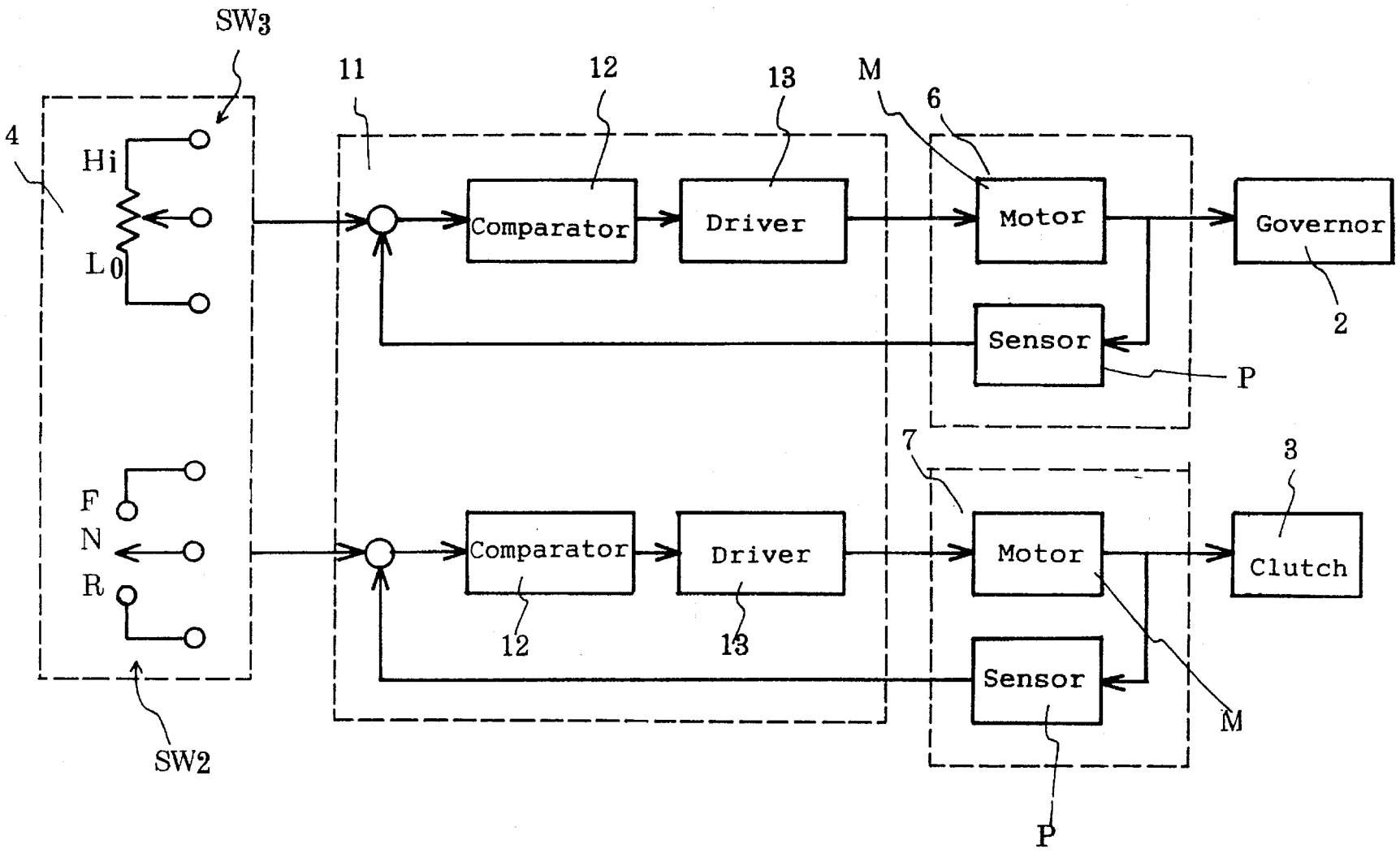
FIG.3 is a block diagram showing the electrical control route of the engine control device of FIG. 2.
Figure 4:
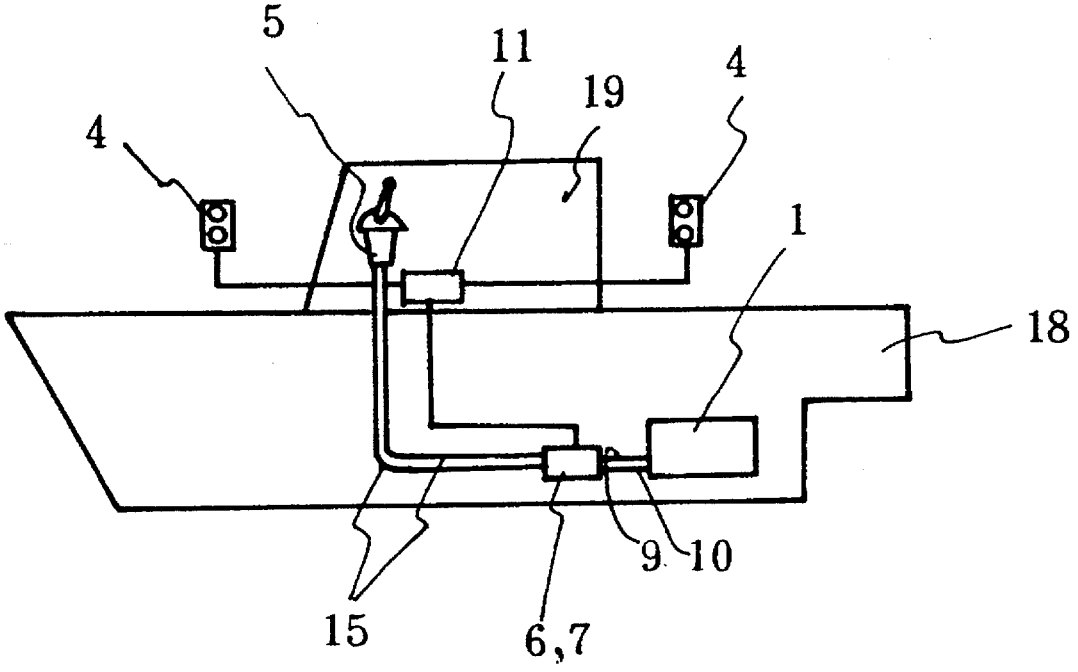
FIG. 4 is a schematic side view of an example of a boat on which an engine control device of the present invention is mounted.

In the beginning, referring to FIGS. 2 to 4, an embodiment of the engine control device of the present invention is explained. The engine control device of FIG. 2 is a system for remote-controlling a governor or throttle operating part 2 of a diesel engine 1 and a clutch or shift operating part 3 of a boat or the like, either by means of an electrically power remocon (remote control) box (signal generator) 4 or by means of manual remocon box 5. Selection of the power remocon box 4 and the manual remocon box 5 is performed by operating knobs 8 of actuators 6 and 7.

The governor operating part 2 of the engine 1 is connected to an output part of the actuator 6 for operating governor through a push-pull control cable 9 for operating governor. The clutch operating part 3 is connected to an output part of another actuator 7 for operating clutch through a push-pull control cable 10 for operating clutch. Further, each actuator 6, 7 has an electric motor (M in FIG. 3), and each motor M is controlled by signal transmitted from the power remocon box 4, 4 through a controller 11.

Each power remocon box 4, 4 has a switch $SW_2$ for changing clutch and another switch $SW_3$ for controlling governor, and is respectively connected to the controller 11 so as to transmit control signal by an operator as shown in FIG. 3.

The controller 11 has a comparator 12 which compares the operation signal with feedback signal from position detector or sensor such as a potentiometer P in the actuator 6, 7, and further calculates motor control signal. The controller 11 also has a driver 13 for transmitting driving signal to the motor M (see FIG. 3). Further, the controller 11 has an on-off switch for electric source and a switch for selecting one of power remocon boxes 4.

Further, in the engine control device A, additional push-pull control cables 15, 15 for governor and clutch are arranged between the actuator 6, 7 and the manual remocon box 5. The manual remocon box 5 is provided with levers 16, 17 for operating the push-pull control cables 15, 15. Hereinafter, the push-pull control cable 15 connected to manual remocon box 5 is referred to as "manual control cable", and the push-pull control cable 9, 10 connected to the engine 1 is referred to as "engine control cable". The above mentioned push-pull control cables can be changed to pull control cables.

Those units of the engine control device A constructed as mentioned above are arranged on a hull of boat 18 as shown in FIG. 4. That is to say, the engine 1 is situated on the stern of the hull 18, and the actuators 6, 7 are arranged at some what front side position of the engine 1. The manual remocon box 5 and the controller 11 are arranged in a cabin, and the power remocon box 4 are connected with the controller 11 by means of long electric cables such that those power remocon boxes 4 can be carried by user and can be set at any position.

Since the governor actuator 6 and the clutch actuator 7 are fundamentally the same, hereinafter, only the governor actuator 6 is explained. The actuator 6 has a basic construction shown in FIG. 1, for example.

Figure 1:
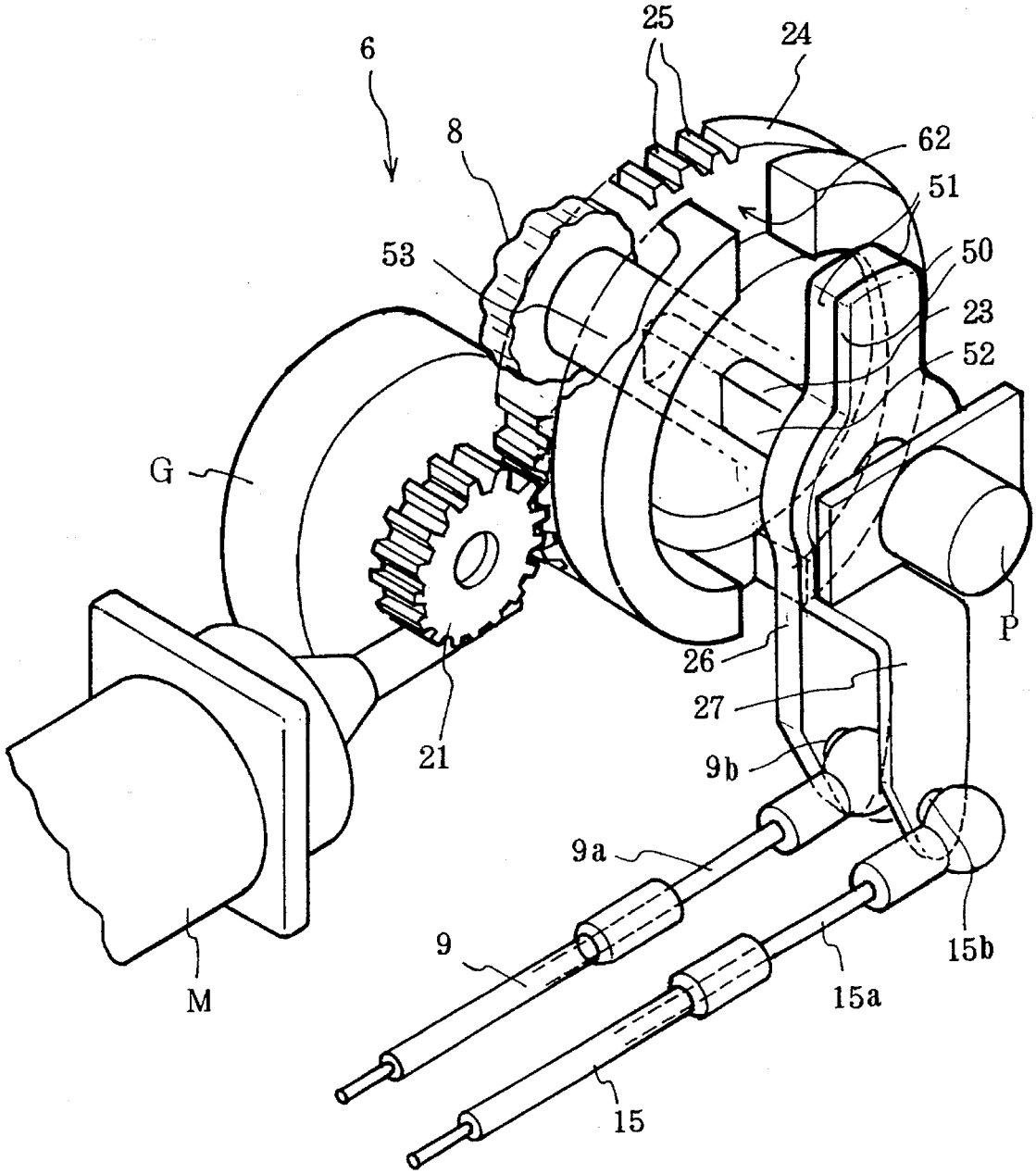
FIG. 1 is a perspective view partially showing an embodiment of an actuator of the present invention.

Referring to FIG. 1, the symbol "M" denotes an electric motor, "G" denotes a reduction gear unit, and "21" denotes a pinion fixed on an output shaft of the reduction gear unit G. On a casing (22 in FIG. 5*a*) of the actuator 6 which is not shown in FIG. 1, a rotary shaft 23 is rotatably mounted. A slide gear 24 is mounted on the rotary shaft 23 so that the slide gear 24 is axially slidable and torque can be transmitted. The slide gear 24 has teeth 25 capable of meshing with the pinion 21 on the periphery thereof.

Further, an output lever 26 is fixed at the front side of the rotary shaft 23, and an manual input lever 27 is rotatably mounted at the front end of the rotary shaft 23. The slide gear 24, the output lever 26 and the manual input lever 27 are mutually concentrically arranged. The output lever 26 is an output member or output rotary member in Claims, and the manual input lever 27 is a manual input member or manual input rotary member in Claims.

The slide gear 24 has a ring-like portion at front peripheral side, and the ring-like portion is formed with cut positions or recesses 62 capable of engaging with the upper and lower side faces of the output lever 26 and the upper side faces of the manual input lever 27.

Beside, the symbol "P" denotes a potentiometer for detecting rotational angle of the output lever 26. The main body of the potentiometer P is fixed on the casing or bracket, and the detecting shaft is engaged with the front end of the rotary shaft 23. Further, "9*a*" and "15*a*" denote cable end rods of the engine control cable 9 and the manual control cable 15.

Figure 5A:
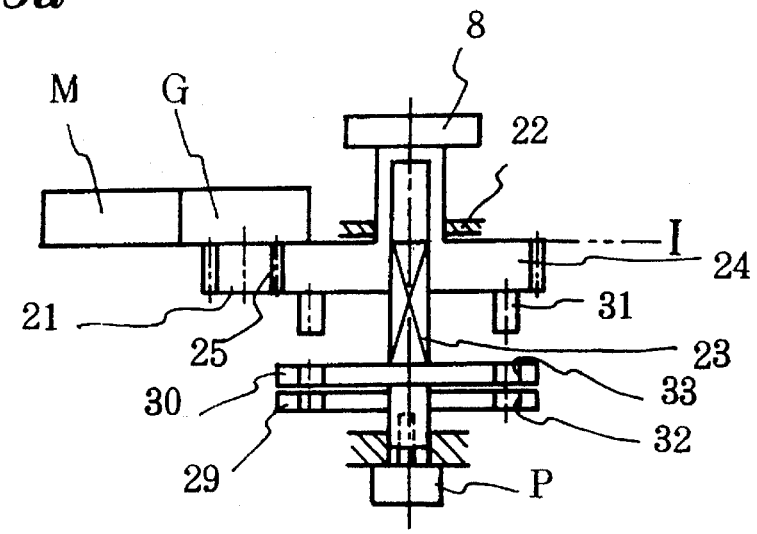
FIGS. 5*a* to 5*c* are schematic plan views showing a basic structure and function of an embodiment of an actuator of the present invention.
Figure 5B:
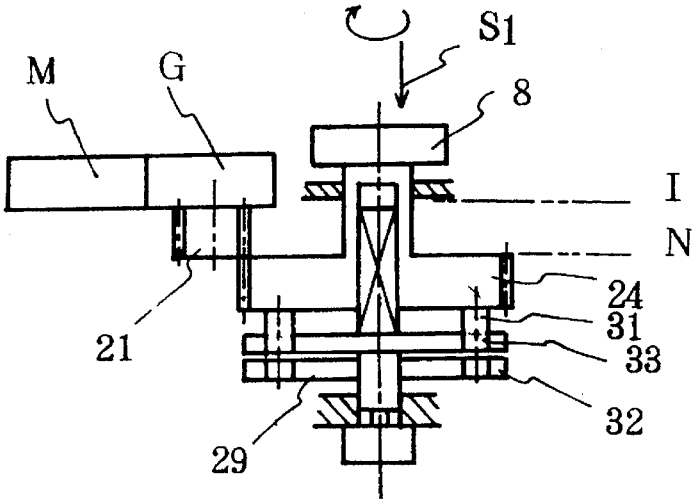
Figure 5C:
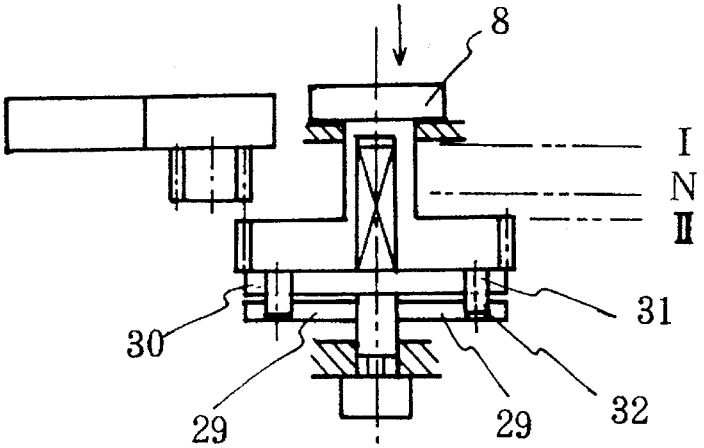

Hereinafter, function of the actuator 6 mentioned above is explained referring to FIGS. 5*a*–5*c*. In FIGS. 5*a*–5*c* the output lever 26 and the manual input lever 27 are changed into an output pulley 30 and a manual input pulley 29. And the engaging means between the slide gear 24 and those pulleys 29, 30 are changed into insertion of pins 31 projecting on the surface of slide gear 24 into holes 32, 33 made in the pulleys 29, 30.

At general power mode, the slide gear 24 is situated at the first axial position I, and the teeth of the slide gear 24 mesh with the pinion 21. In this power mode, rotational torque transmitted to the pinion 21 from the motor M through the reduction gear unit G is further transmitted to the slide gear 24 and the rotary shaft 23, in that order. Then, the operational force of the output pulley 30 which is fixed to the rotary shaft 23 is transmitted to the engine control cable. At this mode, signal of command or order from the power remocon box 4 of FIG. 2 and FIG. 3 is send to the controller 11, and the controller 11 sends a driving signal to the motor M or until the feedback signal from the potentiometer P accords to the order signal.

At emergency state, the device is changed to manual mode. That is to say, as shown in FIG. 5*b*, the knob 8 is pushed in the direction $S_1$ so as to move the slide gear 24 to the neutral position N, and to disconnect the slide gear 24 from the motor M. In this state, the top end of pin 31 might remain in the hole 33 of the output pulley 30. However, the pin 31 is drawn out of the hole 32 of the manual input pulley 29, The slide gear 24 is therefore free from the motor M and also from the manual input pulley 29. Then, the slide gear 24 is rotated until the pins 31 accord to the hole 32 of the manual input pulley 29 by rotating the knob 8.

Next, the knob 8 is pushed in as shown in FIG. 5*c*, so that the pins 31 are inserted into holes 32 of the manual input pulley 29. Then, the output pulley 30 and the manual input pulley 29 are jointed by mean of the pins 31.

Under the situation, by operating the lever 17 of the manual remocon box 5, the governor operating part 2 of engine 1 can be remotely controlled through the manual control cable 15, the manual input pulley 29, the output pulley 30 and the governor control cable 9.

Beside, since the potentiometer P for detecting state of engine is attached at the end of rotary shaft 23, the relation between the potentiometer P and the output pulley 30 is not changed in any mode. And the relationship between the potentiometer P and the engine 1 therefore is fixed. Therefore, the detected value of potentiometer P can be used for various aims. For example, the value can be displayed in a display panel as a operation state, and also can be utilize as a signal for various interlocking signal. Further, when the device is returned to power operation mode from manual operation mode, the slide gear 24 might be engaged with the pinion 21 at any rotational angle. That is to say, the controller 11 can receive feedback signal corresponding to the instant state of the engine 1, at any angle.

Next, referring to FIGS. 6 to 8, the whole construction of the actuator 6 is concretely explained hereinafter.

Figure 6:
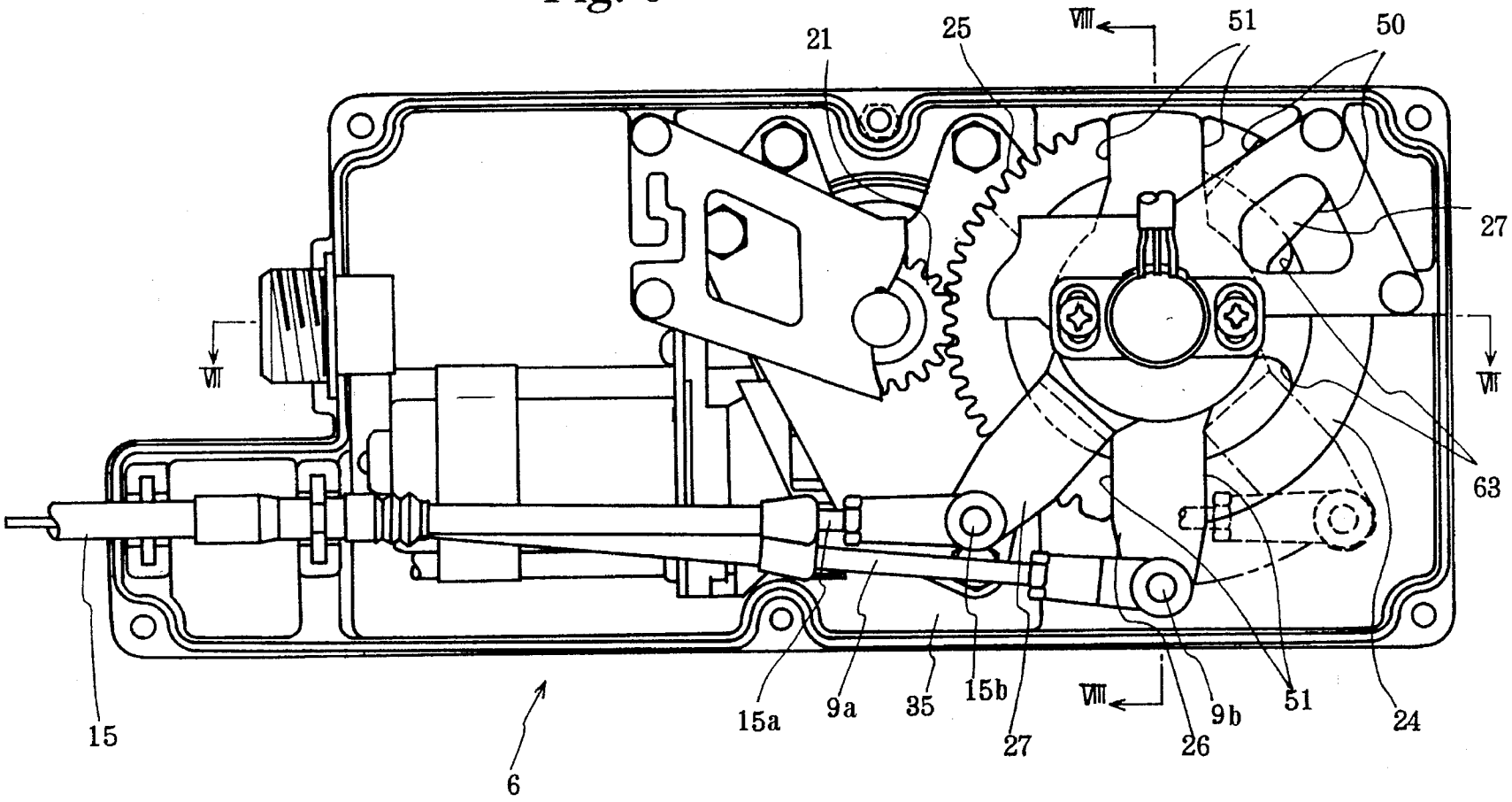
FIG. 6 is a front view of an embodiment of an actuator of the present invention.

Referring to FIG. 6, numeral 35 denotes a casing body. The casing body 35 and a cover 36 are parts of a casing. The casing body 35 shown in FIGS. 7 and 8 has a base portion 37 for fixing the casing to a hull of boat. Such casing body 35 and the cover 36 might be molded out of synthetic resin such as polyacetal resin.

Figure 7:
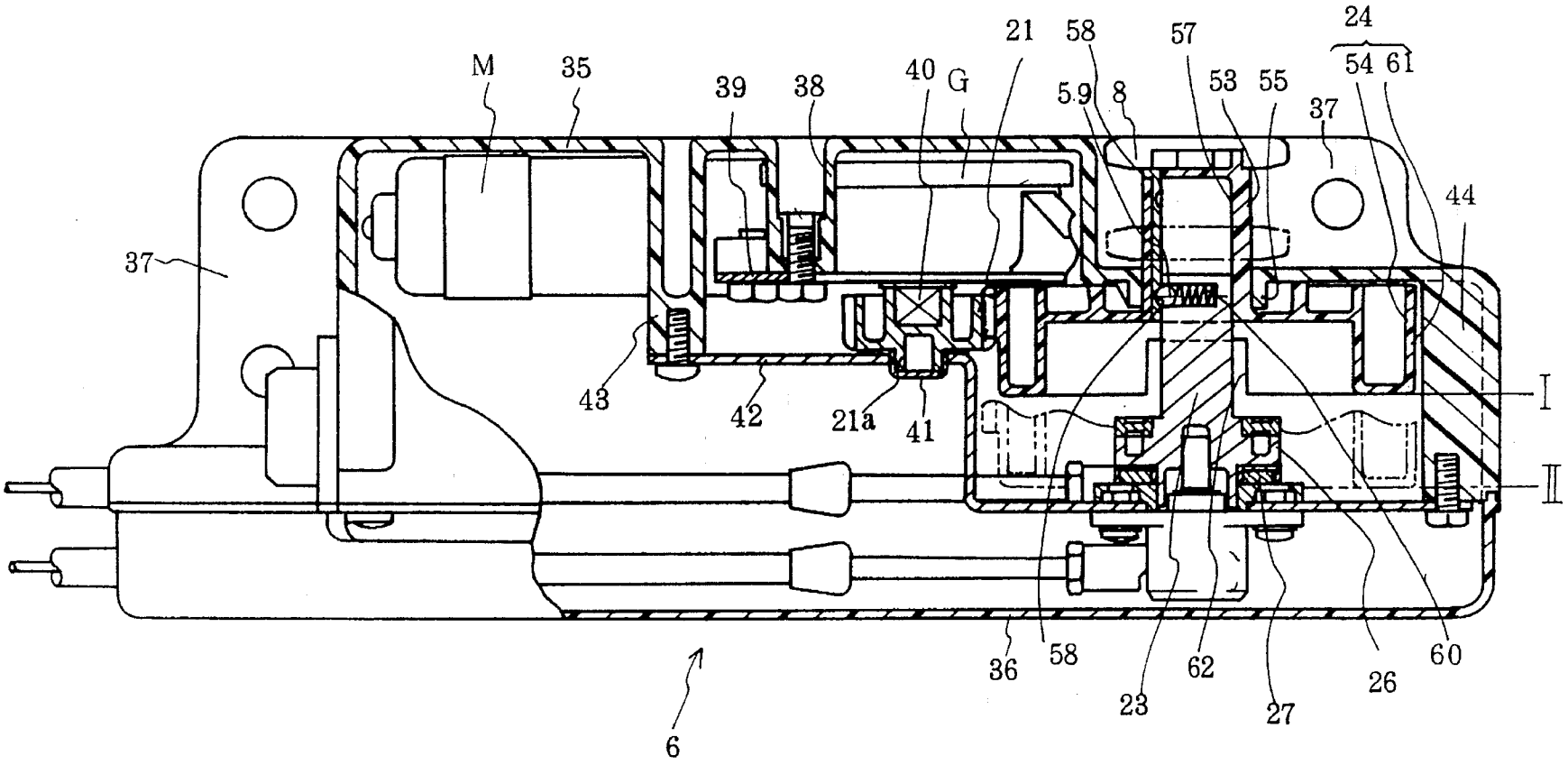
FIG. 7 is a sectional view along line VII—VII in FIG. 6.

As shown in FIG. 7, the casing body 35 has plural, e.g. three in FIG. 7, short projections 38 at the bottom portion thereof, and a bracket 39 for attaching the reduction gear G is attached on the projection 38 by means of screws. The bracket 39 is made of metal sheet such as stainless steel sheet or the like. The reduction gear G having a worm and a worm wheel is attached at the back surface of the bracket 38. A motor M is for driving the worm is attached on the side surface of the reduction gear G.

A pinion 21 is mounted on the output shaft 40 of the reduction gear G. The pinion 21 might be a die-cast product made of die-cast alloy such as zinc alloy. The top end 21*a* of the pinion 21 is rotatably supported by a bearing lush 41 made of synthetic resin, and the bearing bush 41 is embedded in a bracket 42 for bearing. The bracket 42 is made of a metal sheet such as stainless sheet and is attached to high projections 43 standing on a bottom of the casing body 35 and to the projection 44 at the side wall of the casing body 35.

Figure 8:
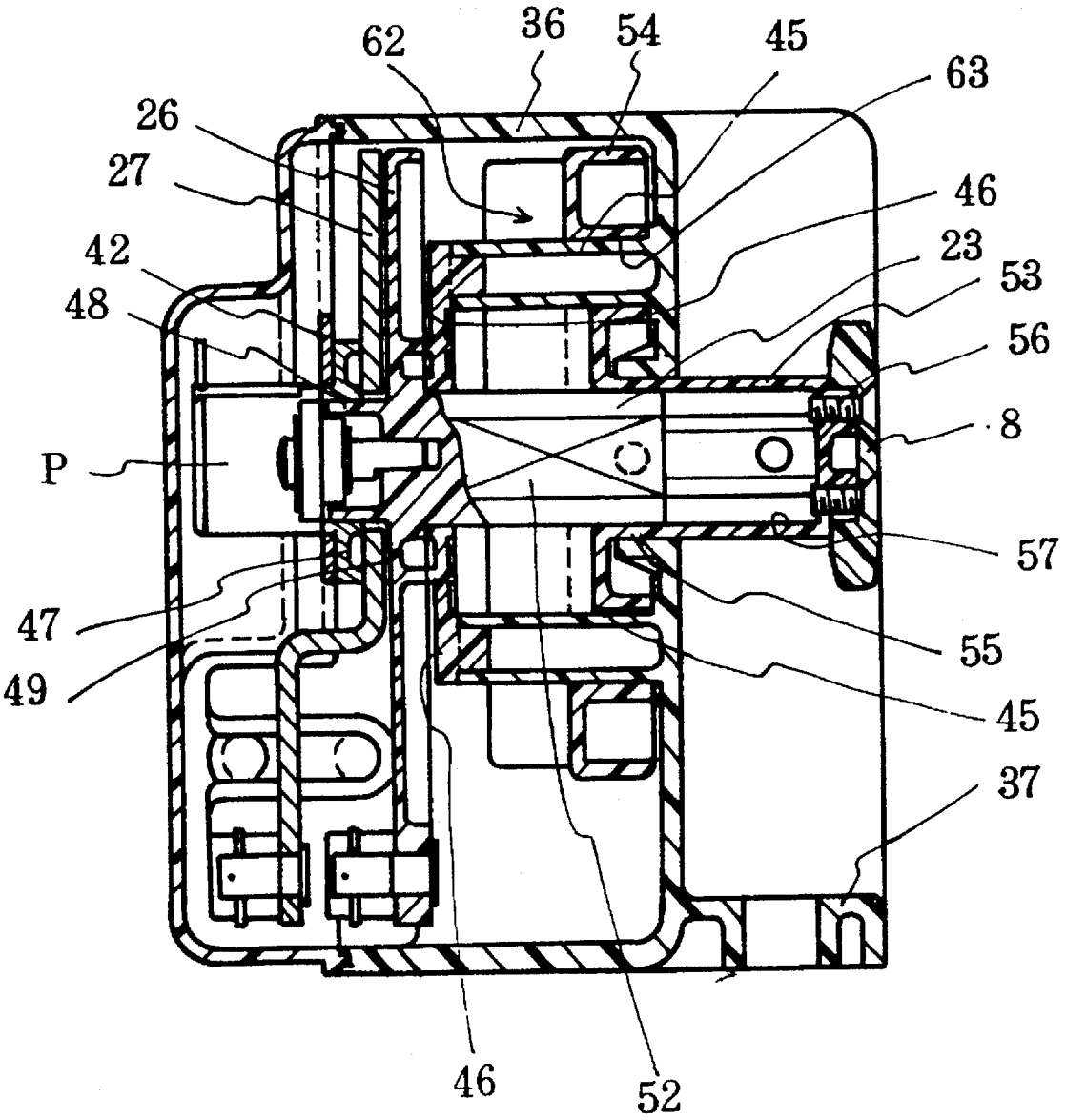
FIG. 8 is a sectional view along line VIII—VIII in FIG. 6.

As shown in FIG. 8, additional a pair of cylindrical projections 45 on the bottom of the casing body 35, and a bearing member 46 made of synthetic resin is attached on the top end of the cylindrical projections 45. A bearing member 47 made of synthetic resin is attached to the above mentioned metal bearing bracket 42 so as to correspond to the bearing member 46. A rotary shaft 23 is supported by the bearing members 46 and 47 so that the rotary shaft can rotate and cannot axially move.

The rotary shaft 23 is provided with a cylindrical wall portion 48 at the end thereof, and the cylindrical wall portion 48 is inserted through a hole made in the bearing member 47. Further, a manual input lever 27 is rotatably mounted on the cylindrical wall portion 48 through a cylindrical bearing bush 49. The manual input lever 27 has a pair of parallel side faces 50 at upper portion thereof, as shown in FIG. 6. The lower side of the lever 27 is bent forward, and the lower end is further bent downward, as shown in FIG. 1. A cable end rod 15*a* of the manual control cable 15 is jointed to the lower end of the manual input lever 27 by means of a pin 15*b*.

Referring to FIG. 8, an output lever 26 is fixed on the rotary shaft 25 at an axial position near the end of the rotary shaft 25. As shown in FIG. 6, the output lever 26 has two pairs of parallel sides 51 at the upper portion and lower position thereof. Then, a cable end rod 9*a* of engine control cable 9 is jointed to the lower end of the output lever 26 by means of a pin 9*b*.

Referring to FIG. 8 and FIG. 1, the rotary shaft has a pair of flat faces parallel with the axis thereof at the rear side thereof. The rear side is inserted into a boss portion 53 of the slide gear 24 so that the slide gear 24 can slide axially with holding torque transmittable engagement.

Referring to FIG. 7 and FIG. 8, a slide gear 24 is formed as one body including a cylindrical boss portion 53 and a disk-like portion 53. The boss portion 55 is inserted into a nearing boss 55 formed on the bottom of the casing body 35, and is rotatably and axially slidably supported by the bearing boss 55. The free end of the boss portion 53 is projected out of the casing body 35, and a knob 8 is fixed to the free end by means of two screws 56 with flat head.

Further, as shown in FIG. 7, the boss portion 53 is formed with a deep hole 57 with parallel flat faces to be engaged with the flat faces at the rear end of the rotary shaft 23. In the inner surface of the deep hole 57, two semi-spherical recesses 58 are formed for determining stoppage positions with distance in axial direction. Those recesses 58 are selectively engaged with a ball 59 so as to provide a detention mechanism. The ball 59 is inserted in a through hole which is made in the wall of the rotary shaft 23 and extends radially, and the ball 59 is urged by a spring 60 in the radial outward direction. By virtue of such detention mechanism, the slide gear 24 can be stated at the first position I and the second position II shown by imaginary line.

As mentioned above, the boss 53 of the slide gear 24 and the rotary shaft 23 are arranged as a telescopic tube structure. Therefore, the rear end of the boss 53 of the slide gear 24 can be projected from the casing body 35, and the knob 8 can therefore be fixed directly on the boss 53. By virtue of such telescopic structure, the actuator can be made thin in axial thickness, and the mode change operation can be performed safely. In such construction, the rear side of the rotary shaft 23 is supported by the bearing boss portion 55 of the casing body 35 through the boss 53 of slide gear.

The front disk-like portion 54 of the slide gear 24 has a ring-like projection 61 projecting forward at periphery of front surface thereof. Further, the ring-like projection 61 is formed with teeth 25 capable of engaging with the pinion 21 at the outer peripheral surface thereof in an area of almost 180°. Such ring-like projection 61 and teeth arrangement 25 are clearly shown in FIG. 1. The ring-like projection 61 is provided with a pair of recesses 62 capable of engaging with the side faces of output lever 26 and manual input lever 27, at the upper portion and the lower portion thereof, respectively. The above mentioned disk-like portion 54 is provided with two arc-like through-holes 63 for inserting the cylindrical projections 45 at the inside of the ring-like projection 61.

Figure 9A:
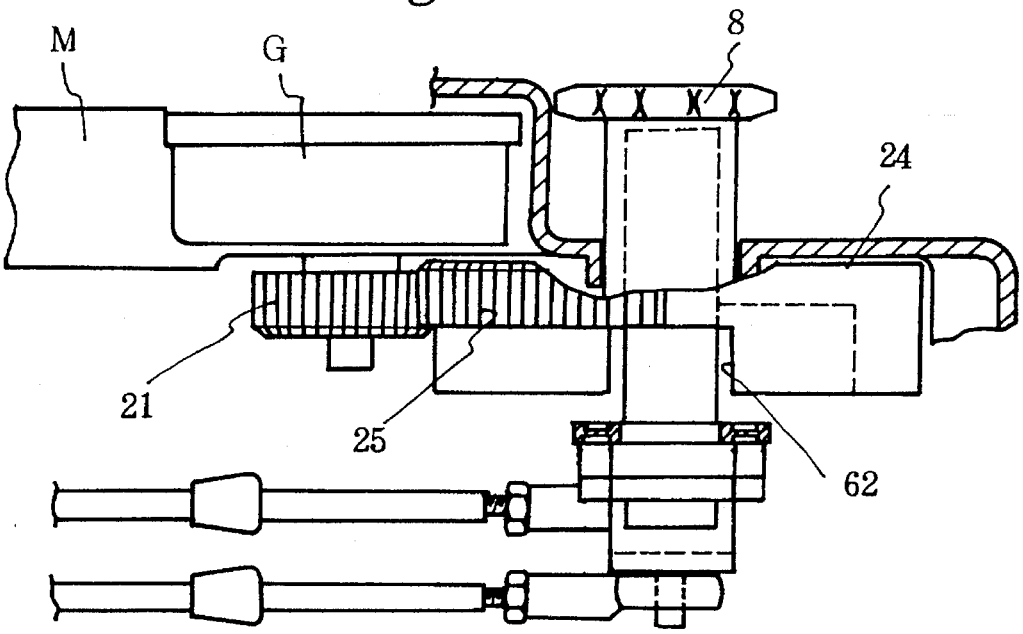
FIG. 9*a* and FIG. 9*b* are schematic plan views showing the shifting function of the actuator of FIG. 6, respectively.
Figure 9B:
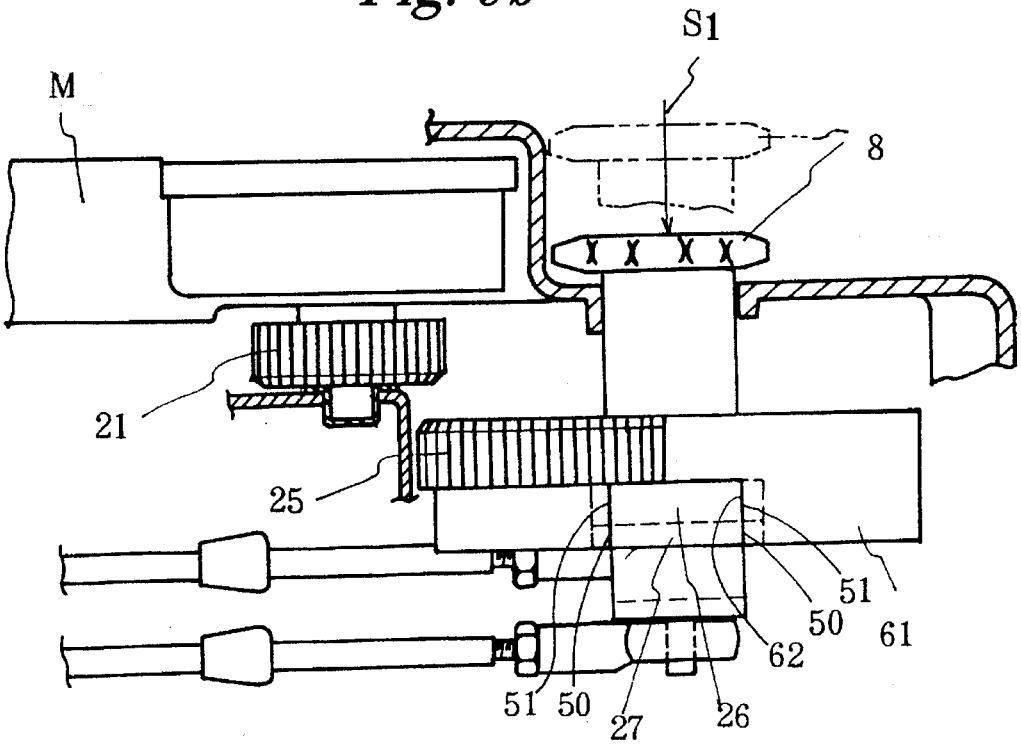

The function of the above-mentioned actuator 6 is substantially same as the function of the actuator of FIG. 5. That is to say, at general powered mode, the knob 8 is pulled out as shown in FIG. 9*a* so that the pinion 21 meshes with teeth of the slide gear 24. And in manual mode, the knob 8 is pushed in the direction of arrow $S_1$ to the neutral position. Then, the knob 8 is rotated to accord the recess 62 of the ring-like projection 61 to the parallel side faces 50 of the manual input lever 27, and the knob 8 is further pushed in, so as to joint the recess 62 on the lever 27. Then, the output lever 26 and the manual input lever 27 are jointed with each other by means of inside surfaces of the recess 62 of the ring-like projection 61.

In the above mentioned embodiment, since the manual input lever 27 and the output lever 26 are concentrically arranged and are jointed by the slide gear, those levers do not receive influence of torsional deflection. And therefore, operation feeling is good. However, the present invention is not limited to such case. For example, the manual input lever 27 and the output lever 26 might be changed in position with each other so that the recess 62 of the slide gear 24 or the pins 31 in FIG. 5 can engage with the manual input lever 27 only. Further, instead of the recess 62 of ring-like projection 61 or the pins 31, another engaging means can be employed.

By employing the engine control device of the present invention, the engine can be manually controlled from cabin or the like, at emergency state. The actuator of the present invention is simple in construction and small in size, and further, the operation for changing mode is easy and accurate. Further, operation area in manual mode can be in the ordinary area, and therefore, return operation is also easy.

Though various preferable embodiments are described above with reference to the attached drawings, the present invention is not limited to the above embodiments, and various changes and modifications can be made without departing from the scope and spirit of the invention.

What I claimed is:

1. An engine control device comprising:

a signal generating unit to be operated by an operator for generating an engine control signal;

a controller for receiving the engine control signal and for outputting a motor control signal in accordance with the engine control signal;

an actuator having an electric motor which rotates in accordance with the motor control signal and a cable driving part for driving an engine control cable;

a manual remote control unit; and a manual control cable operated by the manual remote control unit;

wherein said cable driving part of the actuator has a power input member rotated by the motor;

a manual input member rotated by the manual control cable;

an output member connected with the engine control cable;

an intermediate member for selectively connecting one of the input members to the output member and, at the same time, disconnecting another input member from the output member; and a means for operating the intermediate member.

2. The engine control device according to claim 1, wherein, said intermediate member is arranged for disconnection from both said power input member and said manual input member when said intermediate member is in a neutral position.

3. An actuator for operating an engine control cable comprising:

a pinion driven by an electric motor;

an output member adapted to operate an engine control cable;

a manual input member adapted to be driven through a manual control cable;

a rotary shaft rotatably supported in a casing and fixedly carrying the output member;

a slide gear carried on the rotary shaft so as to be axially slidable and torque-transmittable;

said slide gear having teeth which mesh with the pinion at a first axial position and having an engaging portion which interlocks with the manual input member at a second axial position; and a means for selectively shifting the slide gear to the first position or the second position.

4. The actuator of claim 3 further comprising a detector for detecting an angular position of the rotary shaft in order to feedback the angular position to an electric circuit for controlling the motor.

5. The actuator of claim 3 wherein the manual input member is concentrically rotatable with the output member and is situated opposite to the slide gear with respect to the output member, and the engaging portion of the slide gear engages with the output member and the manual input member at the same time when the slide gear comes to the second axial position.

6. The actuator of claim 3 wherein the slide gear has a boss axially slidable on the rotary shaft;

the boss is supported rotatably by the casing and is axially slidable; and the means for selectively shifting the slide gear is a knob fixed to an outer end of the boss which is projected out of the casing.

7. An actuator for operating an engine control cable comprising:

a pinion driven by an electric motor;

an output member adapted to operate an engine control cable;

a manual input member adapted to be driven through a manual control cable;

a rotary shaft rotatably supported in a casing and fixedly carrying the output member;

a slide gear carried on the rotary shaft so as to be axially slidable and torque-transmittable;

said slide gear having teeth which mesh with the pinion at a first axial position and having an engaging portion which interlocks with the manual input member at a second axial position; and a means for selectively shifting the slide gear to the first position or the second position, wherein said slide gear is able to be shifted at a neutral position where the slide gear neither meshes with the pinion nor engages with the output member; and the means for selectively shifting the slide gear has an element for rotating the slide gear.

8. The actuator of claim 7 further comprising a detector for detecting an angular position of the rotary shaft in order to feedback the angular position to an electric circuit for controlling the motor.

9. The actuator of claim 7 wherein the manual input member is concentrically rotatable with the output member and is situated opposite to the slide gear with respect to the output member, and the engaging portion of the slide gear engages with the output member and the input member at the same time when the slide gear comes to the second axial position.

10. The actuator of claim 7 wherein the slide gear has a boss axially slidable on the rotary shaft;

the boss is supported rotatably by the casing and is axially slidable; and the means for selectively shifting the slide gear is a knob fixed to an outer end of the boss which is projected out of the casing.

* * * * *